US005402755A

United States Patent [19]

Waissi

[11] Patent Number: 5,402,755

[45] Date of Patent: Apr. 4, 1995

[54] INTERNAL COMBUSTION (IC) ENGINE

[76] Inventor: Gary R. Waissi, 1038 Greenhills Dr., Ann Arbor, Mich. 48105

[21] Appl. No.: 106,900

[22] Filed: Aug. 16, 1993

[51] Int. Cl.[6] ..... F02B 75/24

[52] U.S. Cl. ..... 123/55.3; 123/197.4

[58] Field of Search ..... 123/56 A, 56 AC, 56 R, 123/56 C, 197.4

[56] References Cited

U.S. PATENT DOCUMENTS

| | | | |
|---|---|---|---|
| 399,593 | 3/1889 | Worth | 123/56 C |
| 1,766,829 | 6/1930 | Myers | 123/56 C |
| 1,792,062 | 2/1931 | Barnum | 123/56 C |
| 3,388,603 | 6/1968 | Clark . | |
| 3,517,652 | 6/1970 | Albertson | 123/65 |
| 3,828,655 | 8/1974 | Williams . | |
| 4,013,048 | 3/1977 | Reitz | 123/56 BC |
| 4,408,578 | 10/1983 | Konther et al. | 123/56 R |
| 4,453,504 | 6/1984 | Freeman et al. | 123/52 B |
| 4,485,768 | 12/1984 | Heniges | 123/48 B |
| 4,510,894 | 4/1985 | Williams | 123/48 R |
| 4,641,611 | 2/1987 | Stiller et al. | 123/55 A |
| 4,682,569 | 7/1987 | Stiller et al. | 123/55 A |

FOREIGN PATENT DOCUMENTS

| | | | |
|---|---|---|---|
| 476666 | 5/1929 | Germany | 123/56 C |

*Primary Examiner*—Noah P. Kamen

[57] ABSTRACT

An internal combustion (IC) engine with at least one pair of aligned and opposed cylinders has a reciprocating double-headed piston in each cylinder pair. The axis of the double-headed piston is perpendicular to a driveshaft. The reciprocating motion of the double-headed piston is transmitted to the driveshaft by a rotating crankdisk. The crankdisk is rigidly mounted to the driveshaft, which is rotably mounted to a crankcase. The resulting IC engine has a low engine profile, as well as simpler engine construction with fewer moving parts and fewer bearing surfaces compared to conventional IC engines and yoke-type engines.

2 Claims, 3 Drawing Sheets

INTERNAL COMBUSTION (IC) ENGINE

FIELD OF THE INVENTION

This invention relates to an internal combustion (IC) engine, and more particularly to a reciprocating IC engine with opposed aligned cylinders. The invention can be implemented using spark-ignited (SI) and compression ignited (CI), two and four stroke, engine concepts known and disclosed in the prior art.

BACKGROUND OF THE INVENTION

In the conventional reciprocating IC engines, (in-line, V, opposed) the main moving components include: the pistons, the connecting rods, and the crankshaft. In yoke-type engines, according to prior art (e.g. U.S. Pat. Nos. 3,517,652, 4,013,048, 4,485,768), opposed pistons are rigidly connected to each other and various types of slider mechanisms are used to transmit the reciprocating motion of the pistons to a rotating motion of a crankshaft. Other opposed piston engines use various types of camshafts, gear mechanisms, rollers and guides with various piston return means in place of the conventional connecting-rods and crankshaft. (e.g. U.S. Pat. No. 4,510,894, 4,408,578, 4,641,611, 4,682,569). Still other types of engines have pistons parallel to a driveshaft (e.g. U.S. Pat. No. 4,453,504). All these prior art opposed piston engines have mostly become more complicated, with more moving parts, than conventional in-line, V- and opposed engines, and therefore, have mostly not received acceptance among engines manufacturers.

Other prior art patents that have come to my attention include U.S. Pat. Nos. 3,383,603 and 3,828,655.

SUMMARY OF THE INVENTION

A main object of the present invention is to provide a reciprocating IC engine with opposed aligned cylinders, in which the number of main moving parts and bearing surfaces is minimized.

The invention comprises the features hereinafter described and particularly pointed out in the claims. The following description and the attached drawings set forth in detail certain illustrative, however indicative, embodiments of the invention, of but a few ways in which the principles of the invention may be employed.

The main object of this invention has been accomplished by an IC engine comprising of at least one pair of aligned and opposed cylinders wherein a reciprocating double-headed piston is slidably mounted, and in which the cylinder pair and double-headed piston axis intersect perpendicularly with the axis of a driveshaft. The reciprocating motion of the double-headed piston is transmitted to the driveshaft by a rotating crankdisk. The crankdisk is rigidly mounted to the driveshaft, which is rotably mounted to a crankcase.

DESCRIPTION OF THE DRAWINGS

The main object, features and advantages of this invention will become apparent from a consideration of the following description, the appended claims and the accompanying drawings in which:

DETAILED DESCRIPTION

Figure 1:
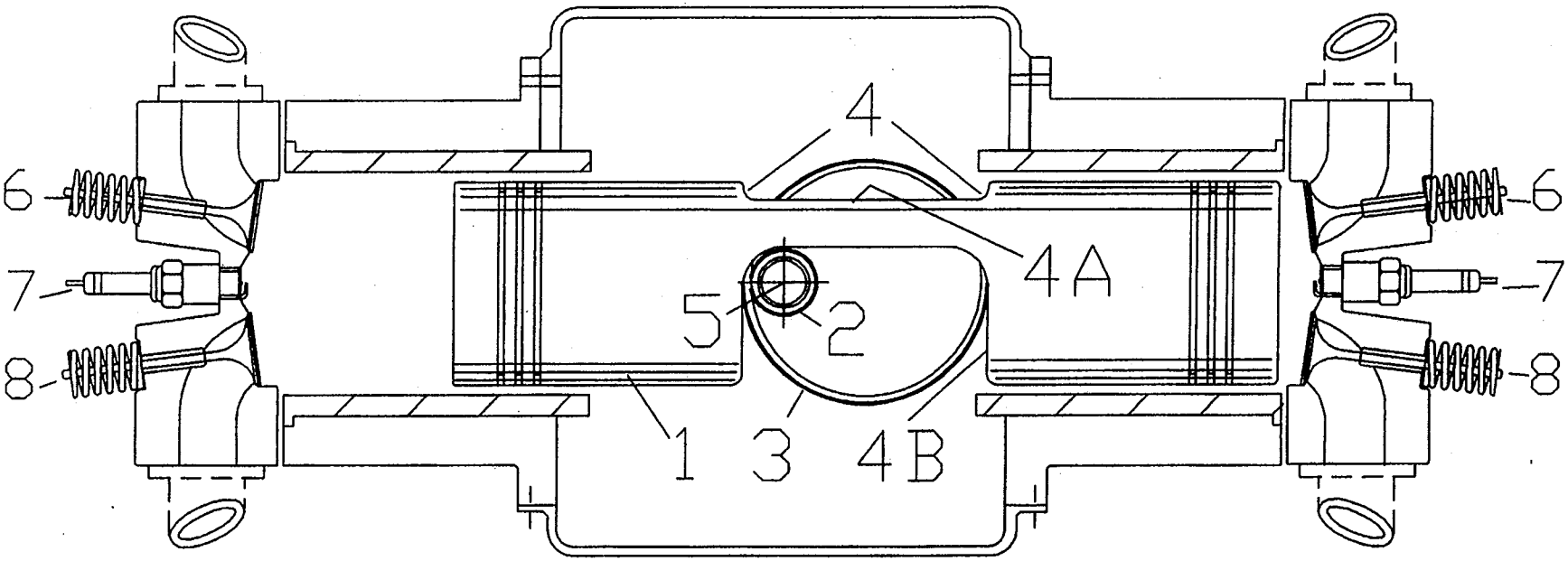
FIG. 1 is a section view of the IC engine, in which a double-headed piston 1 reciprocates, perpendicularly to a driveshaft 2, in aligned and horizontally opposed cylinders.
Figure 2A:
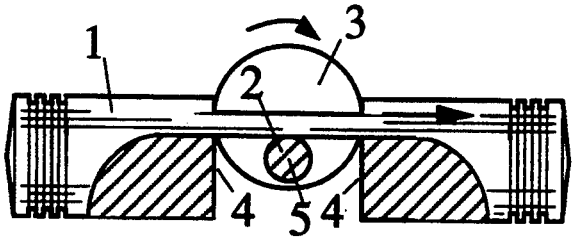
FIG. 2A–2E, illustrate one complete rotation of the driveshaft 2 and crank disk 3, including one complete reciprocating movement cycle of the piston 1.
Figure 2B:
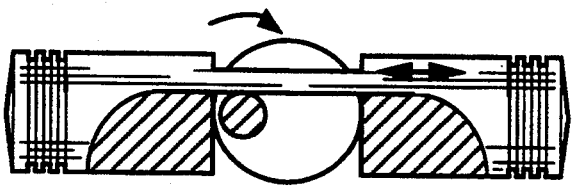
Figure 2C:
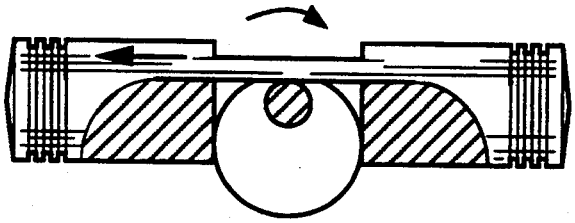
Figure 2D:
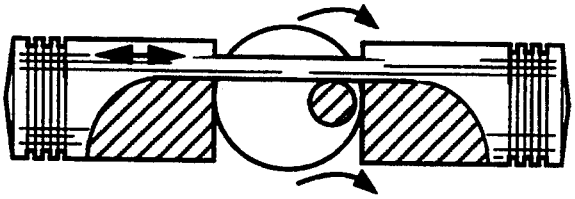
Figure 2E:
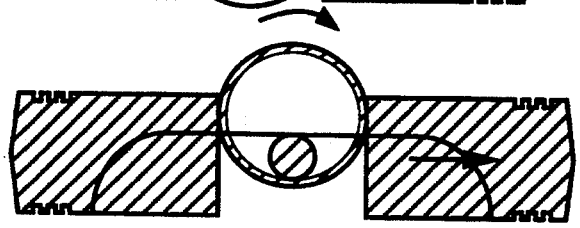

In FIG. 1 the double-headed piston 1 reciprocates, perpendicularly to the driveshaft 2, in the aligned and horizontally opposed cylinders. The driveshaft 2 is rotably mounted to the crankcase. The center axis 5 of tile driveshaft is the center of rotation of the driveshaft. The crankdisk 3 is rigidly and off-centered attached to the driveshaft 2. The crankdisk 3 is located at the piston axis. The outer perimeter surface of the crankdisk 3 acts as a bearing and slides against a bearing surface wall 4 of a slot 4A provided axially through the piston 1. The crankdisk 3 has a diameter that fits tightly but slidably in the slot provided through the piston 1. The piston slot length is equal to the crankdisk 3 diameter plus an acceptable tolerance for bearings known from the prior art. Note that for clarity, significant engine parts are shown only.

In FIG. 2A–2E, the piston 1, driveshaft 2, crankdisk 3 and piston/crankdisk bearing surface 4 are shown. Other engine parts are eliminated for clarity. The FIG. 2A–2E show one complete rotation of the driveshaft 2/crank disk 3, including one complete reciprocating movement cycle of the piston 1. When the piston 1 has reached an extreme position, FIG. 2.B and 2.D, one end of the piston has compressed the air-fuel mixture which ignites either by compression or spark. The expanding gases push the piston to the opposite direction, FIG. 2.A, 2.C, 2.E. As the piston moves it pushes the off-centered and rigidly to the driveshaft attached disk which rotates the driveshaft. The process then repeats itself: the piston 1 moves and pushes the disk 3; the disk 3 slides against the piston slot bearing wall 4; the disk movement causes the driveshaft 2 which is rotably mounted to the crankcase, to turn.

Figure 3A:
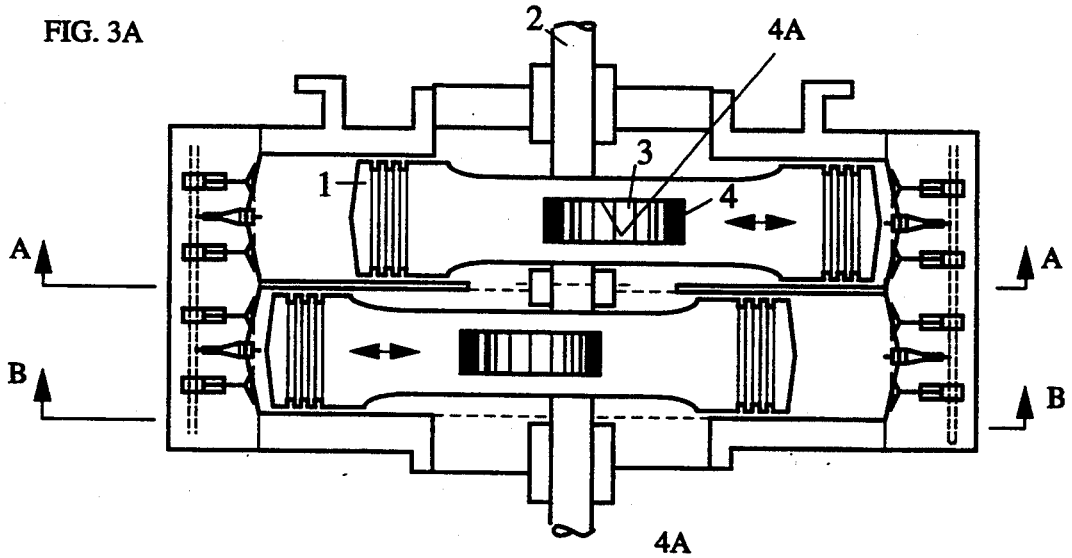
FIG. 3A shows a plan view of a possible arrangement of a two-piston version of the IC engine of FIG. 1.
Figure 3B:
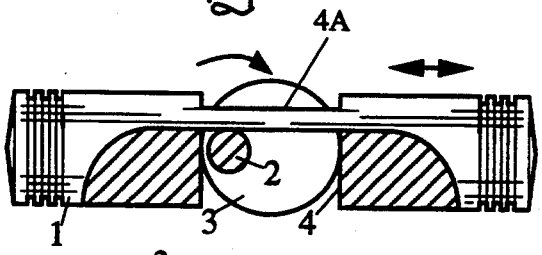
FIG. 3B shows a cross section of the engine of FIG. 3A as seen along lines A—A.
Figure 3C:
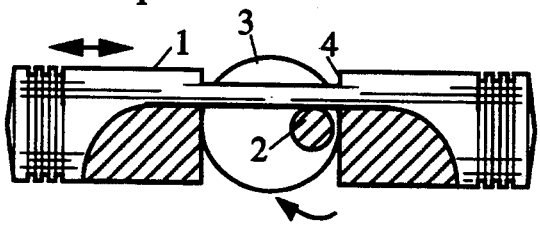
FIG. 3C shows a section of the engine as seen along lines B—B of FIG. 3A.

FIG. 3A and 3B show a top-view and two cross sections of a possible arrangement of a two-piston version of the proposed IC engine. The figure shows the piston 1, the driveshaft 2, the crankdisk 3 and the piston/crankdisk bearing surface 4. The crankdisk off-set is 180° for dynamic balance. For example: a bore (B) of 84 mm, a stroke (S) of 80 mm, crankdisk diameter (D) of 120 mm, driveshaft diameter (d) of 30 mm, and a crankdisk off-set of 40 mm results in a two double-headed piston variation of the proposed type IC engine to 0.4433 liter per cylinder or 1.773 liter engine displaced volume. It has to be noted that preferably $S \leqq B$ for the crankdisk/piston contact point to remain within the piston bearing surface. If $S > B$ is needed then the piston bearing surface has to be extended beyond the piston mantel perimeter.

The Double-headed Piston

The double-headed piston is a closed-end cylinder with conventional type piston hems on both ends. The piston heads are designed as conventional piston heads known and disclosed in the prior art.

The piston is not connected to a connecting rod, and there is neither need for a connecting rod nor a connecting rod pin. Instead, there are one or two longitudinal holes or slots perpendicular to each other through the axis and perpendicular to the axis of the cylindrical piston.

The driveshaft passes perpendicularly through the piston center axis via one, say first slot 4B, of the longitudinal holes or slots. If there is another, say second, hole or slot, like slot 4A shown in the FIG. 1, then the crankdisk or cranking part, attached to the driveshaft and perpendicular to it, uses this second hole or slot to allow the off-centered rotating movement of the crankdisk.

The length of the first slot or opening through the piston for the driveshaft has to be sufficient to allow for a free driveshaft rotation while the piston reciprocates and the off-centered crankdisk attached rigidly to the driveshaft rotates. The driveshaft does not need to have a direct contact with the piston. (Example: Length of slot≧Crankdisk diameter, Width of slot≧Driveshaft diameter) FIG. 1 shows a slot for the driveshaft, which is entirely open on one side (i.e. below) the driveshaft. In FIG. 1 the piston heads are rigidly connected above the driveshaft only, for example, to simplify the assembly process.

The length of the second slot 4B or opening through tile piston for the crankdisk is the disk diameter and an acceptable tolerance known and disclosed in the prior art. The width of the slot depends on the thickness of the crankdisk or cranking part. The slot may also be entirely open on one side for example to simplify assembly. The entire crankdisk may be enclosed inside the piston depending on the piston dimensions.

The piston is slidably connected to the crankdisk, which is rigidly attached to the driveshaft. The crankdisk slides against the inside end bearing surface walls of the piston slot. Clearly, the piston is not a free-piston.

The reciprocating motion of the piston may be horizontal or vertical or in any angle to the horizontal plane. A different angle for the reciprocating motion does not present a different invention or concept. Further, if for any reason a piston is manufactured from multiple components or parts and when assembled forms a double-headed rigid piston, then that does not present a different invention or concept.

The Crankdisk or Cranking Part

The crankdisk is a circular flat disk as shown e.g. in the FIG. 1 and 2. The teaching of this invention is that the form of a cranking part may be such that, when the cranking part rotates the distance of a straight line, through the center of rotation of the driveshaft between the outer perimeter points touching or closest to the piston bearings, remains constant when considering an acceptable tolerance. Obviously, there are many such cranking part outer perimeter design shapes that satisfy this requirement. Other cranking part designs and shapes that accomplish the same task are not considered a different invention or concept. The crankdisk or cranking part may also be designed to fit in a space entirely enclosed by the outside surface of the double-headed piston as mentioned in the previous section.

The Driveshaft

The driveshaft 2 is a round, straight rod with crankcase bearing surfaces and rigidly attached off-centered crankdisks 3, or with respect to their center of rotation, symmetrically centered cranking parts. A crankdisk, or cranking part, is used to transmit the motion from the reciprocating piston to the rotating driveshaft, and/or is used for static and/or dynamic balance.

If for any reason a driveshaft including the crankdisks or cranking parts is manufactured as one part or component, or from multiple parts or components and when assembled forms a driveshaft with at least one crankdisk or cranking part as described above, then that does not present a different invention or concept.

The resulting IC engine has a low profile, and a simpler construction with fewer moving parts and fewer bearing surfaces compared to conventional IC engines. No connecting rods between the piston and a crankshaft are needed. The following table summarizes, as an example, a simplified, but illustrative, comparison of the number of parts of a conventional 4-cylinder IC engine (in-line, V or opposed) vs. a 2-piston (4-cylinder) proposed IC engine: (number and type of parts and accessories not listed are assumed to be equal).

Conventional 4-Cylinder vs. a 2-Piston Version of the Proposed Engine

| | Number of Parts | |
|---|---|---|
| Part | Conventional | Proposed |
| piston | 4 | 2 |
| piston rod | 4 | n/a |
| piston pin | 4 | n/a |
| rod bolt | 8 | n/a |
| crankshaft | 1 | n/a |
| driveshaft | n/a | 1 |
| crankdisk | n/a | 2 |
| bearing | 13 | 7 |
| total | 34 | 12 |

It is appreciated from the FIGS. 1, 2A–2E and 3A–3B and the above detailed description summarily that the novel IC engine has the double-headed piston 1, the driveshaft 2 and the crankdisk 3. These parts replace the conventional piston, the connecting rod and pin, as well as the crankshaft, and form an improved concept for a reciprocating IC engine, which is significantly different from the prior art.

I claim:

1. An internal combustion engine, comprising:

a driveshaft and means mounting the driveshaft for rotation about an axis:

at least one pair of aligned and opposed cylinders;

at least one double-headed piston reciprocating in said pair of cylinders;

a crankdisk rigidly attached to a driveshaft and slidably connected to said piston;

said at least one double-headed piston having a cylindrical body with a piston head at each end;

the piston body having a first slot, a second slot perpendicular to the first slot, each of said slots being perpendicular to the axis of the driveshaft and the crankdisk, the first slot being perpendicular to the piston axis and allowing the rotating movement of the driveshaft, and the second slot allowing the rotating movement of the crankdisk;

the second slot having bearing surfaces for slidably engaging the crankdisk; and the crankdisk having an outer annular surface formed about a center that is laterally offset from the center of rotation of the driveshaft, the annular surface slidably engaging the bearing surfaces of the second slot;

at least one rigid connection between the piston heads of said at least one double-headed piston;

whereby the crankdisk transmits the reciprocating motion of the double-headed piston to the driveshaft and Causes the driveshaft to rotate about its axis.

2. An internal combustion engine as defined in claim 1, in which the crankdisk is a circular disk attached off-centered and rigidly to the driveshaft, the crankdisk having an outer perimeter surface slidably engaging the bearing surfaces of the second slot.

* * * * *